US005287880A

United States Patent [19]

Bouc et al.

[11] Patent Number: 5,287,880

[45] Date of Patent: Feb. 22, 1994

[54] THREE-WAY FIRE HYDRANT

[75] Inventors: Gary Bouc, Decatur; Timothy Logman, Monticello; Carl E. Floren, Decatur, all of Ill.; Al Seitz, Arab, Ala.

[73] Assignee: Mueller Co., Decatur, Ill.

[21] Appl. No.: 824,506

[22] Filed: Jan. 23, 1992

Related U.S. Application Data

[62] Division of Ser. No. 591,979, Oct. 2, 1990, Pat. No. 5,121,772.

[51] Int. Cl.[5] ..... E03B 9/02

[52] U.S. Cl. ..... 137/272; 251/366

[58] Field of Search ..... 137/272, 282, 294, 296; 251/366

[56] References Cited

U.S. PATENT DOCUMENTS

| | | | |
|---|---|---|---|
| Re. 16, 168 | 9/1925 | Charland | 137/272 |
| 28,391 | 5/1860 | Meigs | 137/272 |
| 2,054,561 | 9/1936 | Greenberg | 137/272 |
| 4,000,753 | 1/1977 | Ellis | 137/296 |
| 4,141,574 | 2/1979 | Stansifer et al. | 137/296 |
| 4,440,190 | 4/1984 | Barbe | 137/272 |

*Primary Examiner*—George L. Walton

*Attorney, Agent, or Firm*—Cushman, Darby & Cushman

[57] ABSTRACT

A three-way wet barrel fire hydrant includes an enlarged intermediate barrel section, which effectively reduces pressure loss in the fire hydrant. The hydrant barrel is formed by an improved sand molding process which requires the mold parting line of the barrel to be selected to coincide with the centerline of the upper nozzle opening. In this manner, a pattern which forms the sand mold may be removed cleanly from the molding sand, thereby eliminating the need of multiple side cores during the casting process.

1 Claim, 8 Drawing Sheets

FIG. 1(a)
(PRIOR ART)
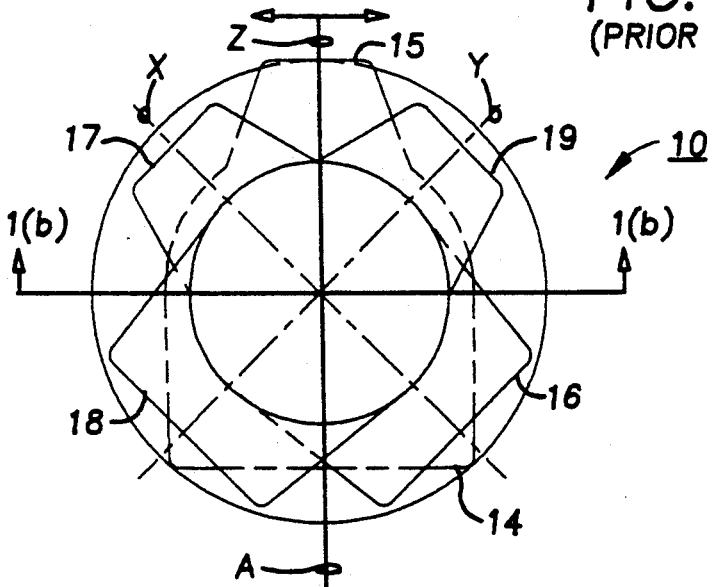
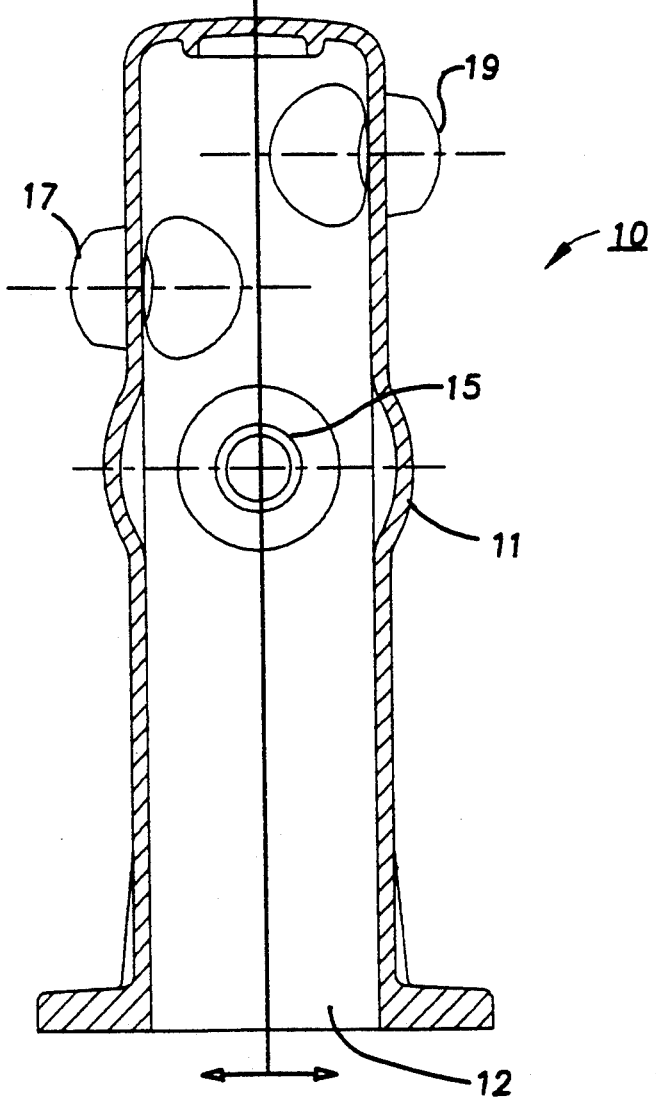
FIG. 1(b)
(PRIOR ART)

FIG. 4(a)
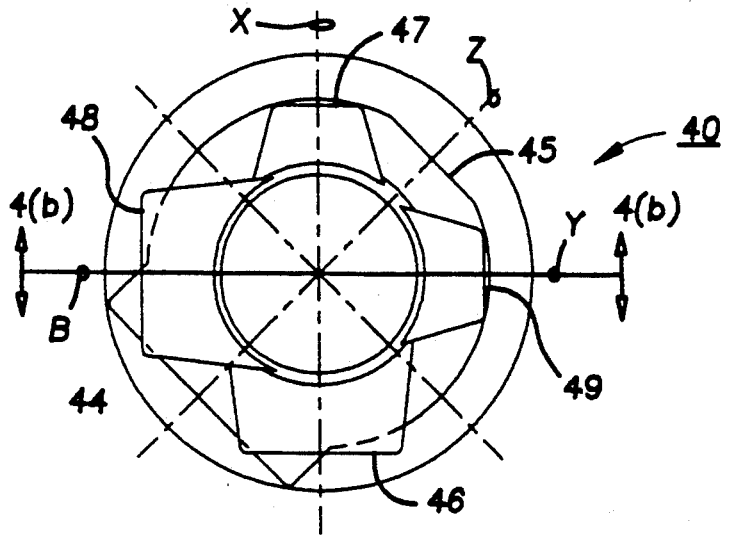
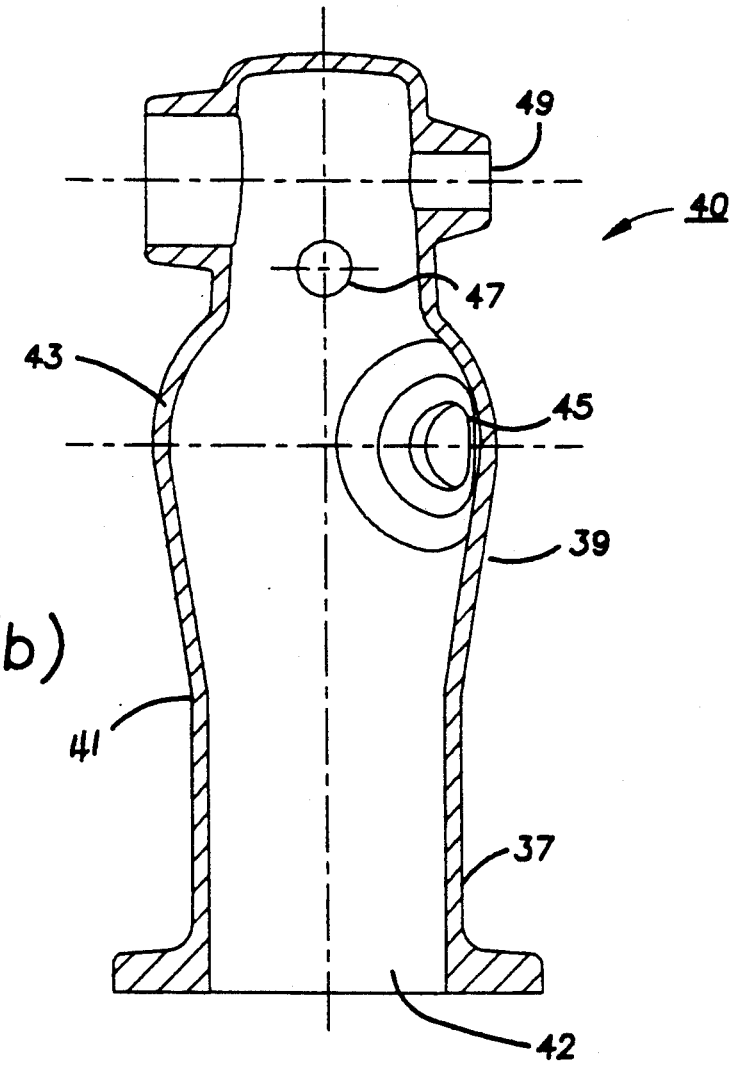
FIG. 4(b)

THREE-WAY FIRE HYDRANT

This is a division of application Ser. No. 07/591,979, filed Oct. 10, 1990, now U.S. Pat. No. 5,121,772.

BACKGROUND OF THE INVENTION

1. Field of the Invention

The present invention relates to a fire hydrant, and more particularly, to a three-way wet barrel fire hydrant having an improved barrel design.

2. Background and Related Art

A "wet barrel" fire hydrant is a type of fire hydrant which retains water in the hydrant barrel during non-use. Wet barrel fire hydrants are employed in temperate climates of the country, such as Hawaii and Southern California, because in climates where the air temperature drops below freezing, the water would freeze within the barrel and render the hydrant inoperative.

A "three-way" wet barrel fire hydrant has three nozzles: one large pumper nozzle and two smaller hose nozzles. The pumper nozzle is adapted to receive a hose connected to a pumper fire truck. Both hose nozzles are adapted to receive hoses employed to extinguish the fire.

According to the three-way fire hydrant hose arrangement, water flows in the following path: from the hydrant pumper nozzle to the pumper truck, where the water pressure is increased; and from the pumper truck to various hose nozzles for application to the fire.

FIGS. 1(*a*) and 1(*b*) show a conventional three-way fire hydrant barrel 10 having a base opening 12, three nozzle openings—a pumper nozzle opening 14, a middle nozzle opening 16 and an upper nozzle opening 18—and three corresponding operating valve stem openings—pumper valve stem opening 15, middle valve stem opening 17 and an upper valve stem opening 19. As shown in FIG. 1(*a*), a cross-sectional centerline X of the corresponding middle nozzle and valve stem openings 16 and 17 and a cross-sectional centerline Y of the corresponding upper nozzle and stem openings 18 and 19 are oriented 45° (or 60° in another embodiment) from a cross-sectional centerline Z of the corresponding pumper nozzle and stem openings 14 and 15. Centerline Z coincides with mold parting line A, which is discussed in more detail below.

As shown in FIG. 1(*b*), the hydrant barrel 10 has an approximately constant diameter along the longitudinal axis. The hydrant barrel 10 has only a slight bulge at an intermediate section 11.

Three-way wet barrel fire hydrants have two primary design considerations. First, a three-way fire hydrant is preferably light weight. Second, a three-way fire hydrant must have low pressure loss. Unfortunately, the two design considerations are in conflict. Conventional three-way wet barrel fire hydrants, such as the one shown in FIGS. 1(*a*) and 1(*b*), fail to satisfy both design considerations. Under conventional designs, either a light weight fire hydrant or a low pressure loss hydrant is possible, but not both.

Conventional methods for manufacturing three-way fire hydrants employ a sand molding process followed by a casting process. During the sand molding process, a pattern 30 having an exterior shape of a three-way fire hydrant shape is pressed into molding sand 20 to form a hydrant sand mold (see FIG. 2). The pattern 30 includes a pumper valve stem projection 32, an upper valve stem projection 34, a middle nozzle projection 36 and a pumper nozzle projection 38. After the molding sand 20 hardens, the pattern 30 is withdrawn (to the left in FIG. 2) leaving a hydrant shaped sand mold.

The above described process forms one half of the mold. A similar process forms the other half of the mold. Both mold halves are joined together around a core 22. The two mold halves and the core 22 define a mold cavity 24 into which molten iron is poured to form a casting as shown in FIG. 3. The core 22 includes three core prints 26*a*, 26*b* and 26*c* which define the pumper nozzle, pumper valve stem and base openings, respectively. The molten metal cools in the mold cavity 24 to form the hydrant barrel. The mold parting line A shown in FIGS. 1(*a*) and 1(*b*) illustrates where the two mold halves are joined.

Conventional methods, however, have several disadvantages. A first disadvantage is illustrated in FIG. 2. When the pattern 3 is withdrawn from the molding sand 20 (to the left in FIG. 2), the upper valve stem projection 34 is pulled through the sand mold in area B and the middle nozzle projection 36 is pulled through the sand mold in area A, leaving undesired voids in the sand mold.

As a result, side cores must be constructed to replace the void areas in the sand mold. The side cores form portions of the upper valve stem opening 19 and the middle nozzle opening 16 which would not otherwise be formed since the molding sand in that area has been removed. In the conventional three-way fire hydrant shown in FIGS. 1(*a*) and 1(*b*), four side cores are employed to form each barrel 10: two side cores for the right half and two for the left half.

Since these side cores are formed by a secondary process, additional time and expense are incurred in the conventional manufacturing method.

A second disadvantage of conventional methods is an inherent problem known as "floating core". The inventors of the present invention have recognized that a significant portion of the weight of conventional three-way hydrants is due to additional wall thickness required by the casting process to compensate for the "floating core" problem. As shown in FIG. 3, core prints 26*a* and 26*b* protrude oppositely from the middle of the core 22 to shape the pumper nozzle opening and the pumper valve stem opening, respectively. A third core print 26*c* protrudes from the base of core 22 to from the base opening. The core prints 26*a*, 26*b* and 26*c* support the core 22 during the casting process. However, since the core prints 26*a* and 26*b* protrude from the middle of the core 22, an overhang portion 28 of the core 22 extends well beyond the support of core prints 26*a* and 26*b*. As a result, the overhang portion 28 may float up or down during solidification of the molten metal. Therefore, a thicker casting average wall thickness is required to maintain the minimum wall thickness required by industry standards, thereby increasing the overall weight of the hydrant.

On possible solution to the "floating core" problem is to move the core prints to the upper portion of the core to better support the overhang portion. However, such a modification under conventional methods results in higher manufacturing costs due to additional side core expense. As discussed above, four side cores are required to form portions of the openings oriented off the mold parting line A. When the core prints protrude from the middle of the core through the pumper nozzle opening and the pumper valve stem opening, side cores must be made for the middle and upper nozzle and valve stem openings. Since the middle and upper nozzle openings are the same size, as are the middle and upper valve stem openings, the same tooling set may be used to make the respective side cores.

On the other hand, if the core prints were positioned on the upper portion of the core to form the upper nozzle and valve stem openings, side cores must be made for the middle nozzle and valve stem openings and the pumper nozzle and valve stem openings, which are different sizes. Thus, additional tooling sets are required to make both sets of side cores, thereby increasing tooling costs. Therefore, conventional methods of manufacturing three-way fire hydrants have opted to reduce tooling costs, while tolerating an increased hydrant weight.

Accordingly, there is a need for a three-way wet barrel fire hydrant which is light weight and has low pressure loss, yet is economically feasible to manufacture.

SUMMARY OF THE INVENTION

The object of present invention is to provide an improved three-way wet barrel fire hydrant which is light weight and has low pressure loss.

Another object of the present invention is to provide an improved three-way wet barrel fire hydrant which is light weight and has low pressure loss, and is economically feasible to manufacture.

Yet another object of the present invention is to provide an improved method for manufacturing a three-way hydrant.

Still another object of the present invention is to provide an improved method for manufacturing a three-way hydrant which reduces the number of necessary side cores employed during the casting process. Further, the improved method effectively eliminates the "floating core" problem experienced in conventional manufacturing methods.

Another object of the present invention is to provide an improved pumper nozzle adapter.

To achieve these objects, the preferred embodiment provides a three-way wet barrel fire hydrant having an enlarged and tapered intermediate barrel section which unexpectedly reduces pressure loss in the fire hydrant.

To form the improved fire hydrants of this invention, the mold parting line is selected to coincide with the centerline of the upper nozzle opening. In this manner, the pattern may be pulled cleanly from the molding sand, causing only one void in the sand. Therefore, only one side core is required during the casting process. This results in significant reduction of manufacturing time and expense.

Further, by rotating the mold parting line, the core prints may now be positioned at the top of the core to better support the core overhang during the casting process. Thus, the "floating core" problem is effectively eliminated, thereby allowing a substantial weight reduction of the fire hydrant.

The present invention further defines an improved pumper nozzle adapter having a smoothly curving inner surface which reduces pressure loss.

BRIEF DESCRIPTION OF THE DRAWINGS

These and other advantages will become more apparent from the detailed description of the preferred embodiment along with the following drawings:

FIG. 1(*a*) shows a top plan view of a conventional three-way wet barrel fire hydrant;

FIG. 1(*b*) shows a side sectional view 1(*a*)–1(*a*) of the conventional three-way wet barrel fire hydrant shown in FIG. 1(*a*);

FIG. 4(*a*) shows a top plan view of a three-way wet barrel fire hydrant according to the present invention;

FIG. 4(*b*) shows a side sectional view 4(*b*)–4(*b*) of the three-way wet barrel fire hydrant shown in FIG. 4(*a*);

DESCRIPTION OF THE PREFERRED EMBODIMENT

Figure 2:
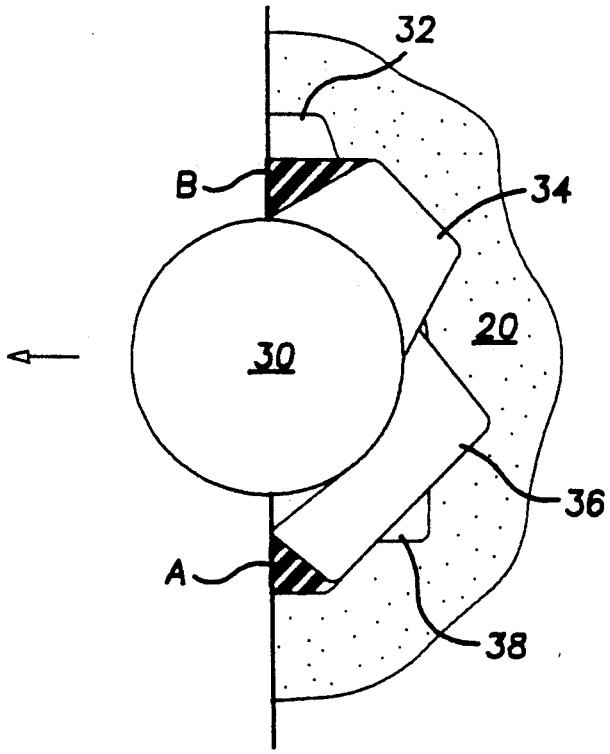
FIG. 2 (PRIOR ART)
FIG. 2 illustrates a conventional sand molding process.

FIGS. 4(*a*) and 4(*b*) show a three-way fire hydrant barrel 40 comprising a base opening 42, three nozzle openings including a pumper nozzle opening 44, a middle nozzle opening 46 and an upper nozzle opening 48 and three corresponding operating valve stem openings including a pumper valve stem opening 45, a middle valve stem opening 47 and an upper valve stem opening 49. As shown in FIG. 4(a), a cross-sectional centerline X of the corresponding middle nozzle and valve stem openings 46 and 47 and a cross-sectional centerline Y of the corresponding upper nozzle and valve stem openings 48 and 49 are oriented 45° from a cross-sectional centerline Z of the corresponding pumper nozzle and valve stem openings 44 and 45. In another embodiment, the upper nozzle and valve stem openings 48 and 49 may be oriented 60° from the cross-sectional centerline Z.

Unlike the conventional fire hydrant shown in FIGS. 1(*a*) and 1(*b*) where the mold parting line A coincided with centerline Z of the pumper nozzle and valve stem openings, mold parting line B is rotated to coincide with centerline Y of the upper nozzle and valve stem openings 48 and 49. The mold parting line B of the hydrant 40 is thus rotated 45° from the centerline Z of the pumper nozzle and valve stem openings 44 and 45.

The hydrant barrel 40 further comprises an enlarged and tapered intermediate section. As shown in FIG. 4(*b*), the hydrant barrel 40 has an approximately constant cross-section in the lower section 37. However, unlike the conventional hydrant barrel 10 of FIG. 1(*b*), the intermediate portion 39 has a continuously expanding cross-section from a minimum cross-section at 41 (i.e., the cross-section of the lower section 37) to a maximum cross-section at 43. Accordingly, the hydrant barrel 40 has a bulge at the pumper valve area of the intermediate portion 39, and then "tapers" to the lower portion 37. The advantages of this enlarged intermediate section is discussed in more detail below with reference to FIGS. 7–9.

Figure 5:
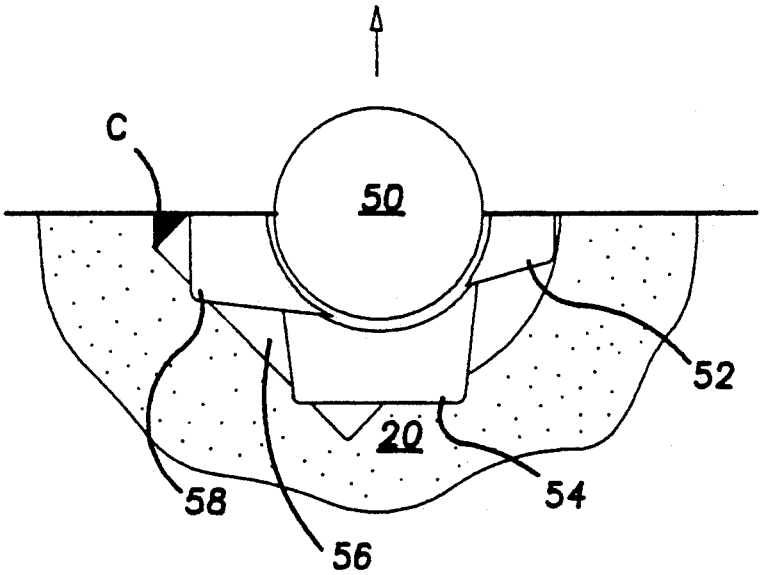
FIG. 5 illustrates a sand molding process according to the present invention.
Figure 3:
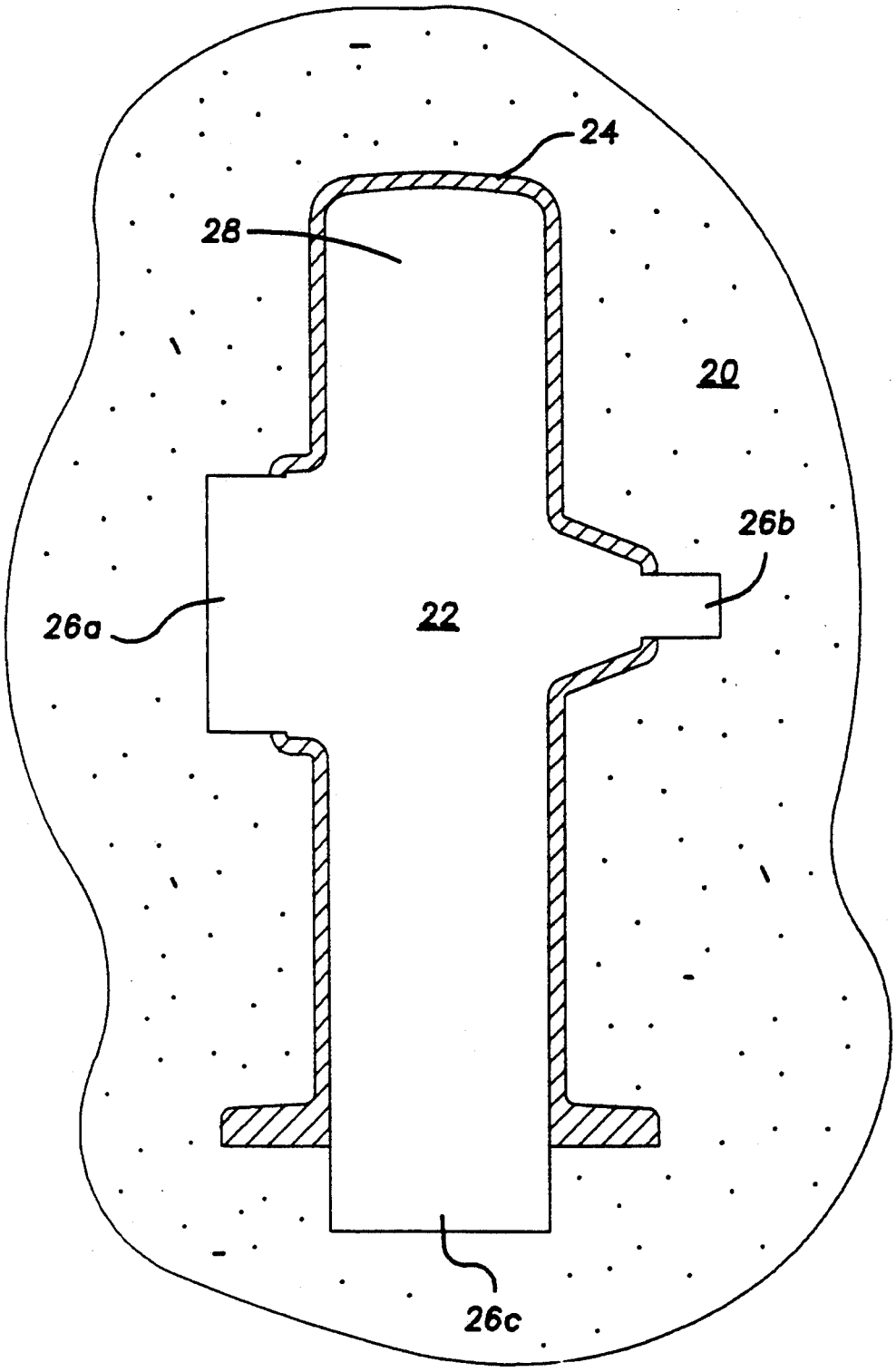
FIG. 3 (PRIOR ART)
FIG. 3 illustrates a conventional casting process.
Figure 6:
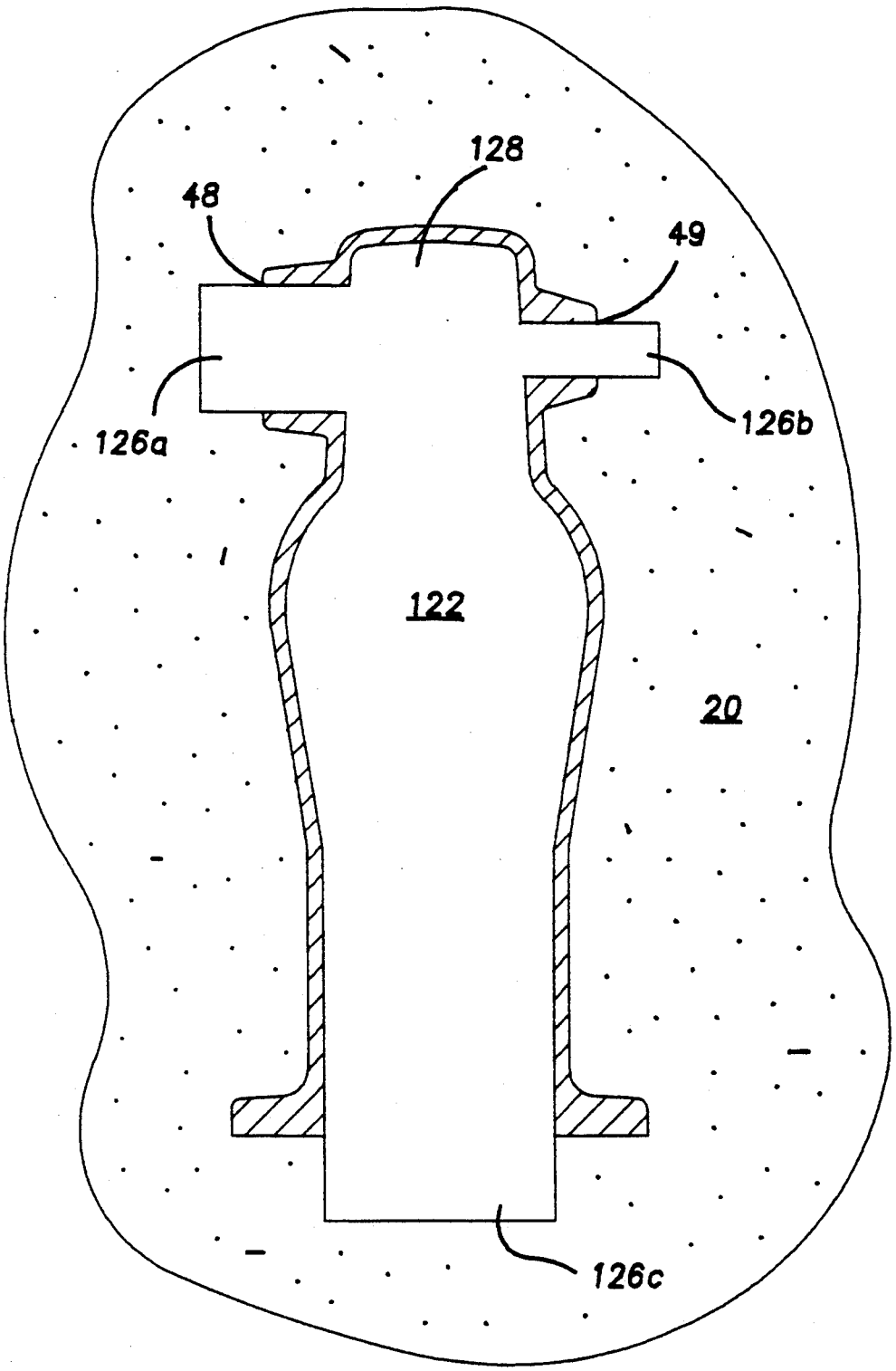
FIG. 6 illustrates a casting process according to the present invention.

The advantages of selecting the mold parting line B to coincide with the centerline Y of the upper nozzle and valve stem openings 48 and 49 will now be described with reference to FIGS. 5 and 6. The first advantage relates to an improvement during the sand molding process. As shown in FIG. 5, the pattern 50 has an upper valve stem projection 52, a middle nozzle projection 54, a pumper nozzle projection 56 and an upper nozzle projection 58. Upon withdrawal of the pattern 50 (upward in FIG. 5), the pumper nozzle projection 56 is pulled through the sand mold in area C, thereby leaving one undesired void in the sand mold. Accordingly, one side core is required to replace the void and form a portion of the curved surface of the pumper nozzle opening 44.

A pattern (not shown) used to form the sand mold for the upper left half of the hydrant barrel does not create any undesirable voids in the sand mold during withdrawal.

Therefore, in contrast to the conventional manufacturing methods which require four side cores to form completely the hydrant barrel, the preferred embodiment of the present invention requires only one side core. The elimination of three side cores from the sand molding process results in a substantial reduction in manufacturing time and expense.

The second advantage of rotating the mold parting line relates to reducing the "floating core" problem in the casting process. As illustrated in FIG. 6, the mold parting line B permits the core prints 126*a* and 126*b* to be positioned at the upper nozzle and valve stem openings 48 and 49, which provides better support of the core 122 during the casting process. Thus, the core overhang 128 is prevented from floating up and down during solidification of the molten metal. As a result, a more accurate wall thickness is obtained and, thus, a thinner casting average wall thickness may be employed to maintain the minimum wall thickness required by industry standards. Therefore, the overall weight of the hydrant can be significantly reduced.

The advantages of the enlarged intermediate section of the hydrant 40 will now be described with reference to FIGS. 7–9.

Figure 7:
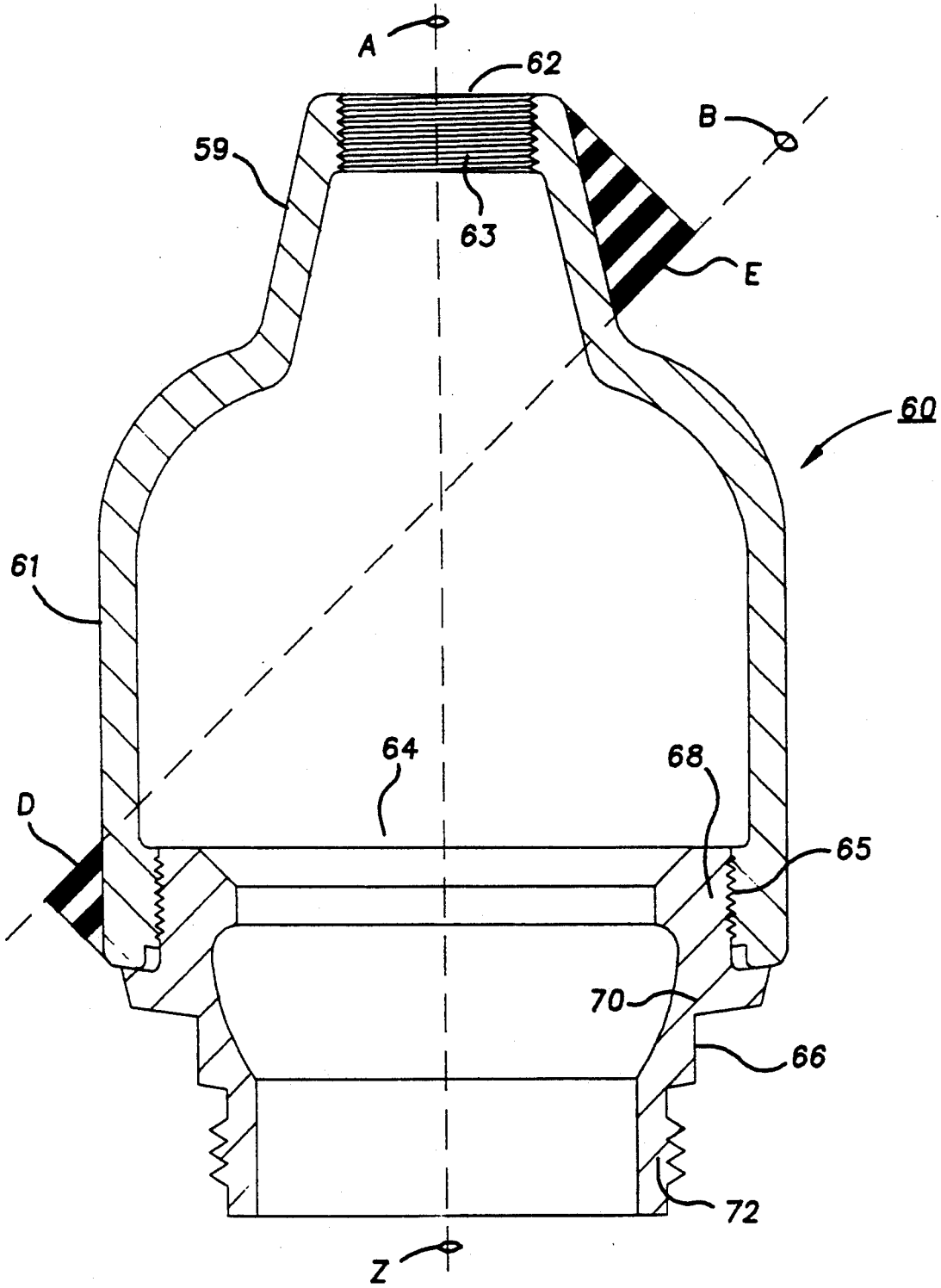
FIG. 7 (PRIOR ART)
FIG. 7 shows a cross-sectional view of a regular sized intermediate section of a conventional three-way wet barrel fire hydrant.

FIG. 7 shows, in sectional view, a conventional, regular sized intermediate section 60 of a hydrant having a substantially cylindrical portion 61 and a substantially conical portion 59. The cylindrical portion 61 has a pumper nozzle opening 64 formed at its end. The pumper nozzle opening 64 is provided with threads for engaging a conventional pumper nozzle adapter 66. The nozzle adapter 66 includes a first threaded region 68, a middle region 70 and a second threaded region 72.

The conical portion 59 has a stuffing box opening 62 formed therein. The stuffing box opening 62 is provided with threads for engaging a stuffing box (not shown).

Figure 8:
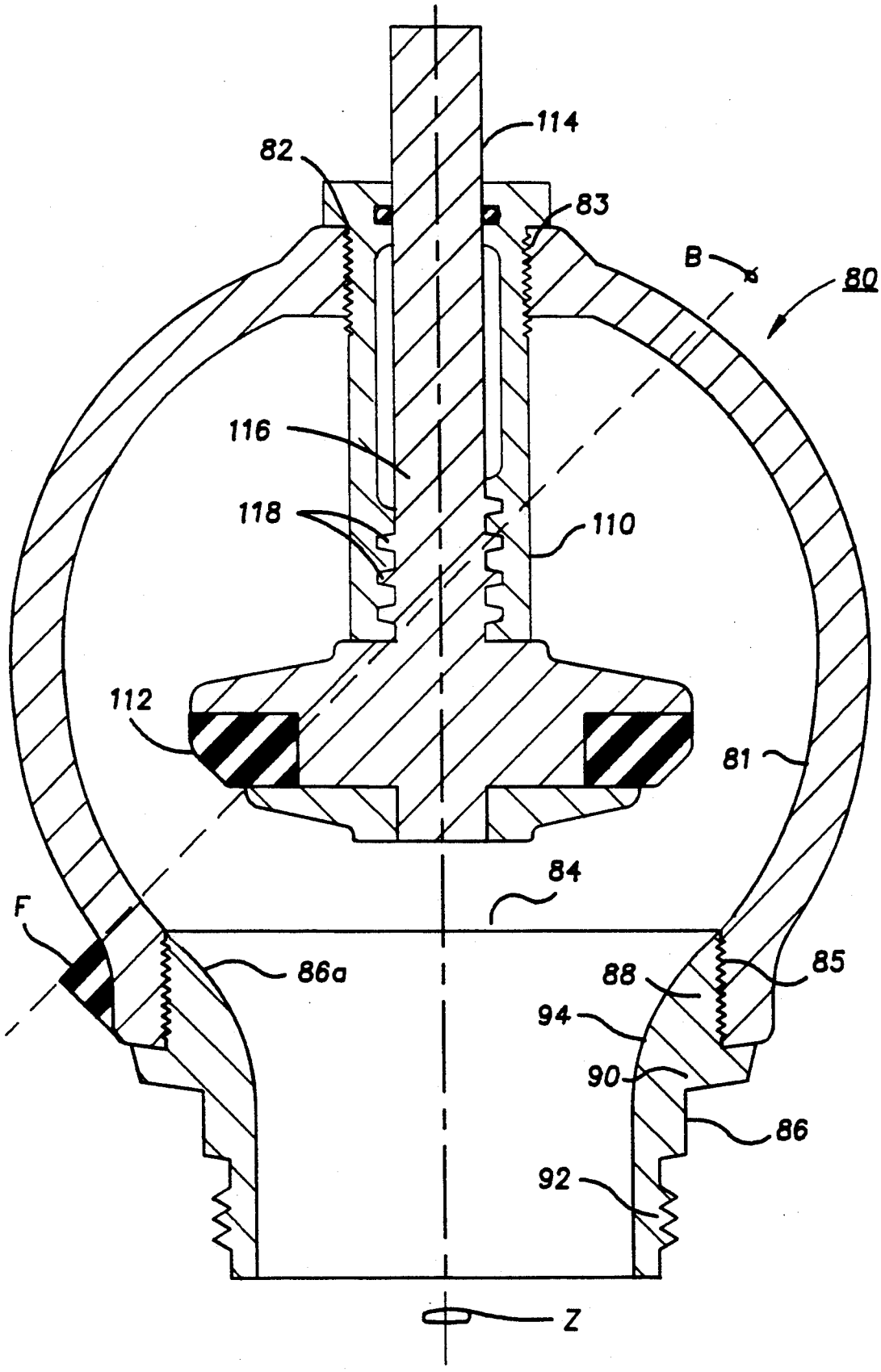
FIG. 8 shows a cross-sectional view of an enlarged intermediate section of a three-way wet barrel fire hydrant according to a first embodiment of the present invention.

FIG. 8 shows, in sectional view, an enlarged intermediate section 80 having a stuffing box opening 82 and a pumper nozzle opening 84 formed therein. The stuffing box opening 82 is formed substantially within the same radial arc of the barrel wall. This design is significantly different than the pumper valve stem opening 62 of the conventional intermediate section 60 shown in FIG. 7, which is formed in the extended conical portion 59.

The pumper valve stem opening 82 is provided with threads 83 for engaging a stuffing box 10. A threaded pumper valve stem 116 is provided with threads 118 for engaging the stuffing box 110. The pumper nozzle opening 84 is provided with threads 85 for engaging an improved pumper nozzle adapter 86, which is described in more detail below.

The pumper valve stem 116 has an end portion 114 which is adapted to cooperate with a tool employed by a user for opening and closing the pumper valve. Opposite the end portion 114 is a valve head 112 which is adapted to abut the inner surface of the nozzle adapter 86. When the fire hydrant is not in use, the valve head 112 is in an engagement position abutting the seat 86*a* of the nozzle adapter 86. On the other hand, to discharge water from the fire hydrant, a user opens the pumper valve by retracting the valve head 112, via rotation of the end portion 114, to the position shown in FIG. 8.

Figure 9:
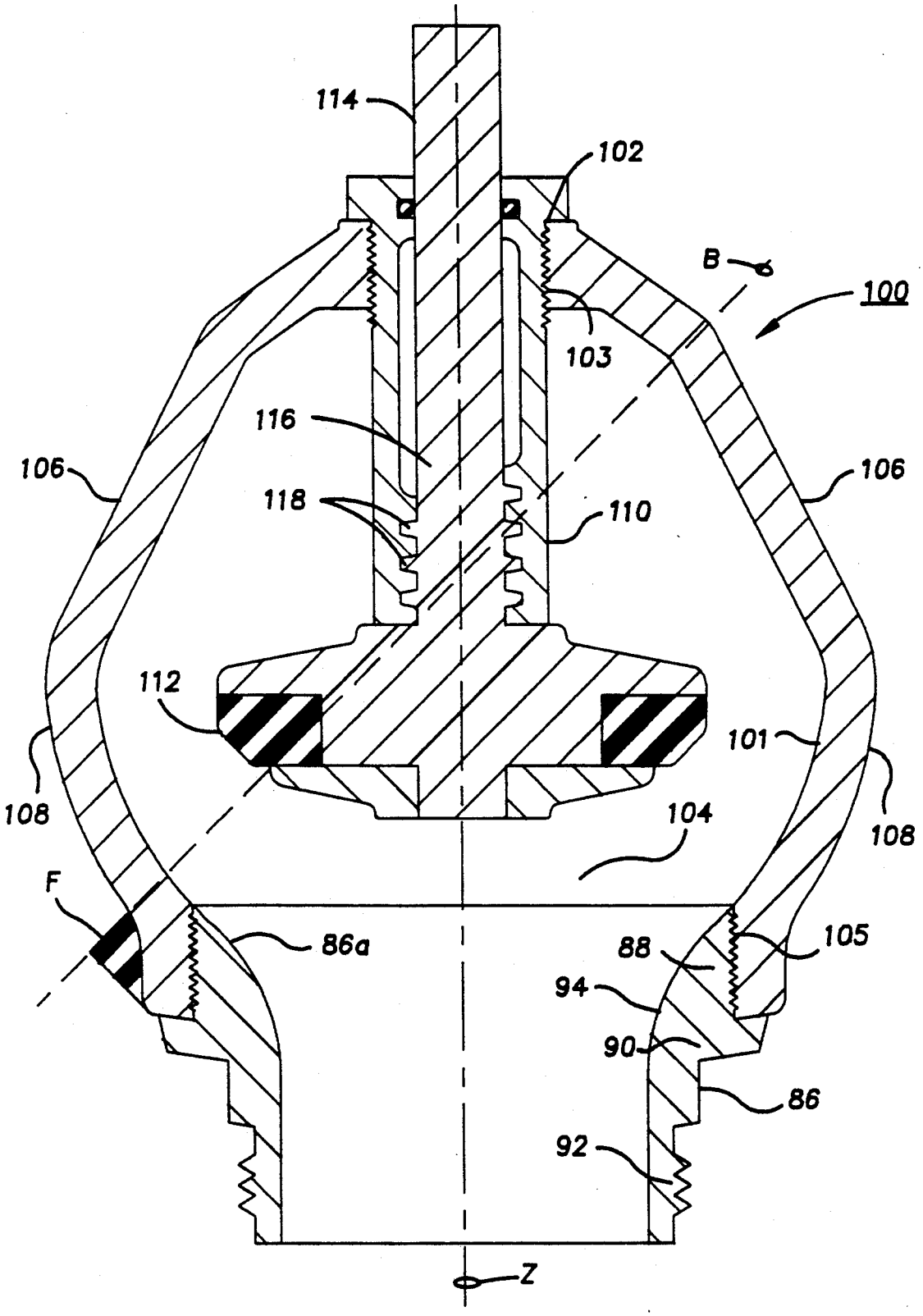
FIG. 9 shows a cross-sectional view of an enlarged intermediate section of a three-way wet barrel fire hydrant according to a second embodiment of the present invention.

FIG. 9 shows a cross-sectional view of a modified enlarged intermediate section 100 having a substantially annular portion 108 and a flat or linear portion 106. The annular portion 108 has a pumper nozzle opening 104 formed therein. The pumper nozzle opening 104 is provided with threads 105 for engaging the nozzle adapter 86.

The linear portion 106 has a stuffing box opening 102 formed therein. The stuffing box opening 102 is formed substantially within the same radial arc defined by the annular portion 108. The stuffing box opening 102 is provided with threads 103 for engaging a stuffing box 110. The stuffing box 110 is provided with threads for engaging threads 118 of the pumper valve stem 116.

As previously discussed, the pumper valve stem 116 has a valve head 112 which is movable between an engagement position to abut the seat 86*a* of the nozzle adapter 86 and a retracted position. The valve head 112 is shown in FIG. 9 in the retracted position within the annular portion 108.

The first advantage of the enlarged intermediate sections 80 and 100 is realized during the sand molding process. As previously described, one advantage of rotating the mold parting to line B is that fewer void areas are created during the withdrawal of the pattern, and thus, fewer side cores are required during the casting process. However, this advantage may only be fully realized if the intermediate section is formed with a round-like shape. As seen in FIG. 7, employing the rotated mold parting line B in the conventional intermediate section still results in the creation of two voids, in areas D and E, during the pattern withdrawal step. The void in area E occurs because the shape of the conventional intermediate section requires an extended conical portion 59.

In contrast, a pattern having the enlarged shape of the present invention as shown in FIGS. 8 and 9 may be withdrawn cleanly from the sand mold, creating only one void in area F. No other void is created because of the round-like shape of the enlarged intermediate section. Accordingly, the enlarged shape reduces the number of void areas in the sand mold, thereby contributing to the reduction in the number of side cores.

A second advantage of the enlarged intermediate sections are that they reduce pressure loss in the fire hydrant. This advantage is supported by the experimental data provided below in Table 1.

The advantages of the improved pumper nozzle adapter 86 of the present invention will now be described with reference to FIGS. 8 and 9. The improved nozzle adapter 86 possesses an advantageously smooth inner surface contour. In comparison to the conventional pumper nozzle adapter 66 shown in FIG. 7, the improved pumper nozzle adapter 86 has a smoothly curving inner surface 94 which follows initially the circular line of the annular inner surface 81, 101 of the enlarged intermediate section 80, 100 and then smoothly curves to a line parallel with the centerline Z of the enlarged intermediate section 80, 100.

The nozzle adapter 86 provides a more effective valve opening because it permits the valve head 112 to move farther into the nozzle adapter 86 during closure, provided that the lengths of the threads 83, 103 at the pumper valve stem opening 82, 102 remain constant. With this length constant, the combination of the enlarged, tapered barrel and the improved nozzle adapter provides the fire hydrant with 15 turns to open, rather than the conventional 13 turns.

Table 1 demonstrates the advantages of the enlarged barrel shape and the improved nozzle adapter with respect to pressure loss. Experiments were conducted using three different barrel shapes in combination with the two different pumper nozzle designs. A first barrel shape B1 was the conventional hydrant barrel 10 shown in FIGS. 1(*b*) and 7. A second barrel shape B2 comprised a round barrel having substantially constant cross-section, as shown in FIG. 1(*b*), but with an enlarged intermediate portion shown in FIG. 8. A third barrel shape B3 comprised a tapered barrel shown in FIG. 4(*b*) and the enlarged intermediate portion shown in FIG. 8. The pressure loss was measured at 1000 gallons per minute (GPM) with the valve opened 13 turns, or 2.6 inches. The results of the experiments are set forth in Table 1.

TABLE 1

| | PRESSURE LOSS AT 1000 GPM (psi) | | |
|---|---|---|---|
| | Barrel B1 | Barrel B2 | Barrel B3 |
| Conventional Nozzle | 3.39 | 3.10 | 2.81 |
| Improved Nozzle | 2.28 | 1.96 | 1.68 |

Table 1 illustrates the advantages of employing a hydrant barrel having an enlarged intermediate section. The barrel shape having the enlarged intermediate section (shown in FIG. 8), with the round barrel (FIG. 1(*b*)) or the tapered barrel (FIG. 4(*b*)), experienced less pressure loss than the conventional barrel. Further, the improved nozzle had lower pressure loss than the conventional nozzle for each barrel type. The three-way fire hydrant having the enlarged and tapered hydrant barrel and the improved nozzle was found to have the lowest pressure loss of 1.68 psi.

It is to be understood that the invention is not limited to the disclosed embodiment, but is intended to cover various modifications and equivalent arrangements included within the spirit and scope of the appended claims.

What is claimed is:

1. A fire hydrant including a nozzle adapter for use with said fire hydrant having a body and an outlet opening and a valve member movable in said body between a retracted position and a forward position, said nozzle adapter comprising a substantially cylindrical body having a longitudinal axis and including a first end portion body having a longitudinal axis and including a first end portion having on the exterior thereof means operably engagable with said fire hydrant, a second end portion having on the exterior thereof means operably engagable with a hose, and an interior wall portion which smoothly curves from the interior of said first end portion to the interior of said second end portion such that (1) the radius from the longitudinal axis to the interior wall portion at said first end portion is larger that the radius from the longitudinal axis to the interior wall portion at said second end portion, and (2) the radius from the longitudinal axis to the interior wall portion never increases when traversing along said longitudinal axis from said first end portion to said second end portion with the transition from the interior wall of said fire hydrant to said interior wall portion of said nozzle adapter being smooth and substantially continuous so that said valve member is movable farther into said interior wall portion of said nozzle adapter to engage said first end portion of said nozzle apparatus to close said opening.

* * * * *